US008061731B2

(12) United States Patent
Popenas

(10) Patent No.: US 8,061,731 B2
(45) Date of Patent: Nov. 22, 2011

(54) SKI BRAKE

(76) Inventor: Michael John Popenas, Dearborn, MI (US)

( * ) Notice: Subject to any disclaimer, the term of this patent is extended or adjusted under 35 U.S.C. 154(b) by 346 days.

(21) Appl. No.: 12/319,204

(22) Filed: Jan. 5, 2009

(65) Prior Publication Data

US 2010/0171287 A1 Jul. 8, 2010

(51) Int. Cl.
*A63C 5/00* (2006.01)

(52) U.S. Cl. ..... 280/604; 280/609

(58) Field of Classification Search ..... 280/604, 280/602, 607, 610, 608, 609, 611
See application file for complete search history.

(56) References Cited

U.S. PATENT DOCUMENTS 3,381,972 A * 5/1968 Miller ..... 280/608
4,223,909 A * 9/1980 Danner et al. ..... 280/604
4,919,447 A * 4/1990 Jackson et al. ..... 280/604
5,046,751 A * 9/1991 Scherubl ..... 280/607
5,167,552 A * 12/1992 Johnson, III ..... 441/74
5,328,200 A * 7/1994 Pelizzari ..... 280/609
5,727,807 A * 3/1998 Krafft et al. ..... 280/609
6,357,781 B1 * 3/2002 Jeandin ..... 280/609
7,138,027 B1 * 11/2006 Canizales et al. ..... 156/245
7,213,828 B2 * 5/2007 Riepler et al. ..... 280/609
7,216,887 B2 * 5/2007 Riepler ..... 280/608
7,341,271 B2 * 3/2008 Bunter ..... 280/602
7,422,228 B2 * 9/2008 Cheung ..... 280/609
7,631,440 B2 * 12/2009 Keen et al. ..... 36/50.1
7,650,848 B2 * 1/2010 Brennan et al. ..... 114/222
7,669,879 B2 * 3/2010 Dykema ..... 280/609
7,758,061 B2 * 7/2010 Staudinger ..... 280/609

* cited by examiner

*Primary Examiner* — Hau Phan

(57) ABSTRACT

According to one embodiment of the invention, a ski brake is positioned on a ski, such that a ski brake device is integrated into a bottom side of a ski and comprises a squeegee cut tread with an open position and a closed position. The squeegee cut tread has an outer surface and an inner surface, wherein the squeegee cut tread exposes the inner surface to a snow surface in the open position when the ski bottom side is in a flexed position. The squeegee cut tread exposes the outer surface to the snow surface in the closed position when the ski bottom is in a non-flexed position.

5 Claims, 4 Drawing Sheets

SKI BRAKE

BACKGROUND

Snow skiers expose their knees, and particularly their anterior cruciate ligament ("ACL"), to injury when they fall or place themselves in a position of imbalance during periods of uncontrolled acceleration. When a skier loses balance and falls backwards placing weight on the back of the skis, the front of the skis flex in an upward position. As the skis flex in the upward position, the skis accelerate uncontrollably thus placing greater strain and force on the skier's ACL and potentially causing injury.

SUMMARY OF THE INVENTION

According to one embodiment of the invention, a ski brake is positioned on a ski such that it comprises a ski brake device with two sides. One side attaches to the bottom side of a ski while the other side contacts a snow surface and includes a squeegee cut tread. The squeegee cut tread is capable of utilizing an open position to reduce ski acceleration and a closed position for normal operation. The squeegee cut tread further comprises an outer surface and an inner surface, wherein the inner surface is exposed to the snow surface while in the open position and the outer surface is exposed to the snow surface while in the closed position.

Some embodiments of the invention provide numerous technical advantages. When the squeegee cut tread is in the open position, the inner surface is exposed to the snow surface applying a frictional force to the snow surface that reduces the acceleration of the ski. The reduction in ski acceleration causes a reduction in force exerted on a skier that is transferred to the skier's knee or ACL. When the ski returns to a non-flexed position, the squeegee cut tread returns to the closed position and the ski is available for normal operation.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION

Figures 1, 1A:
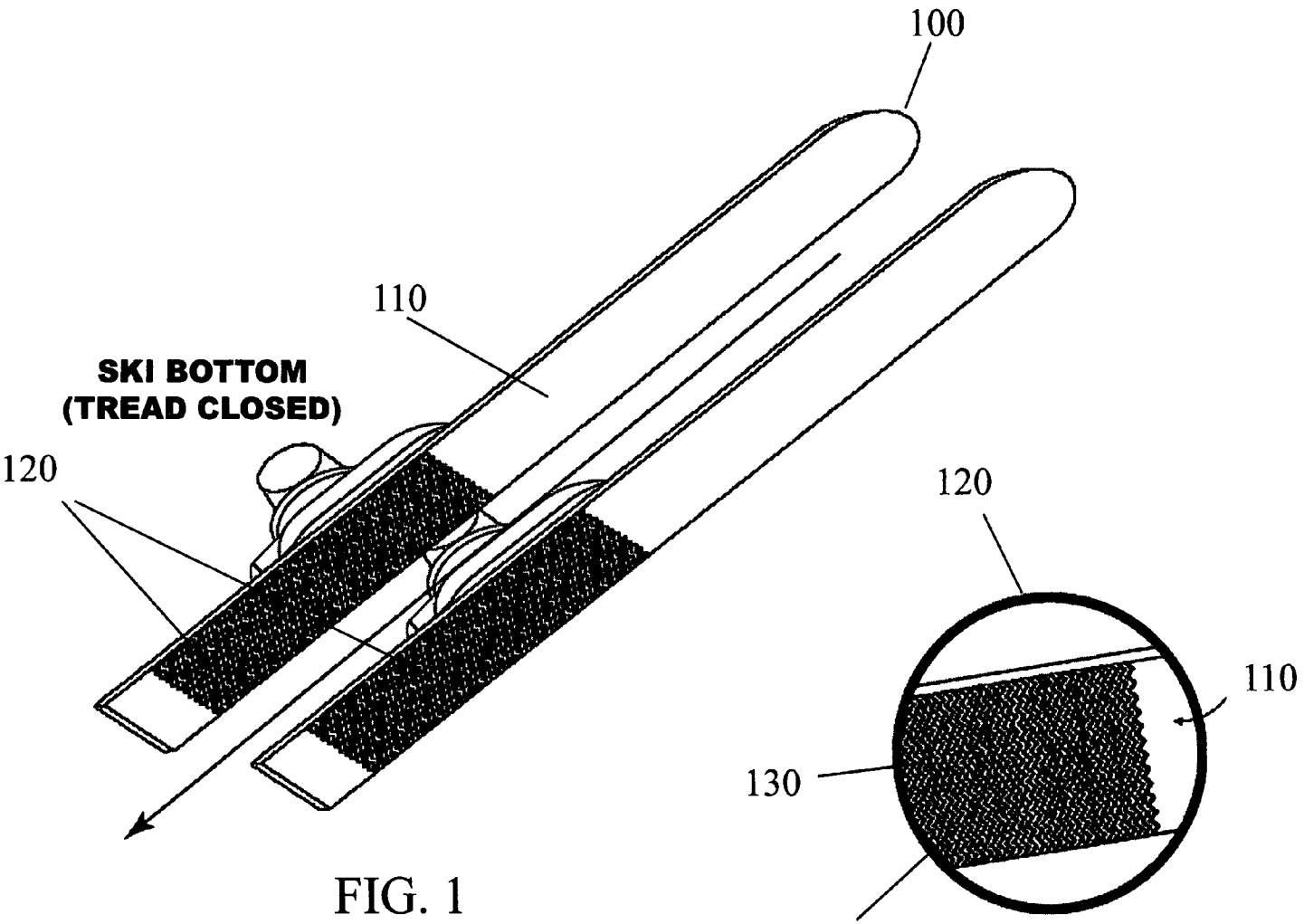
FIG. 1 is a perspective view illustrating a brake integrated into a ski and in the closed position when the ski is in a rest position.
FIG. 1A is a perspective view illustrating a close up of the brake shown in FIG. 1.

FIG. 1 is a perspective view illustrating a ski brake device 120 that is integrated into a ski bottom 110 while a ski 100 is in a rest position, i.e., not in a flexed position. As shown in FIG. 1A, ski brake device 120 further comprises a squeegee cut tread 130 that has a number of ridges positioned adjacent to one another. Brake device 120 can be integrated into the ski bottom 110 of ski 100, or attached to the ski bottom 110 using any known attachable mechanism, such as, for example, adhesive, screws, rivets, permanent or reattachable fasteners, or any combination thereof.

Returning to FIG. 1A, when ski bottom 110 is in the rest or non-flexed position, the squeegee cut tread 130 of brake device 120 is in a closed position. While in the closed position, the ridges of squeegee cut tread 130 are adjacent to one another enabling squeegee cut tread 130 to expose an outer surface 160 to a snow surface. The outer surface 160 of squeegee cut tread 130 is substantially non-abrasive and allows ski bottom 110 to travel over the snow surface in a substantially similar manner as that of a ski equipped without brake device 120 or a similar device.

Figure 2:
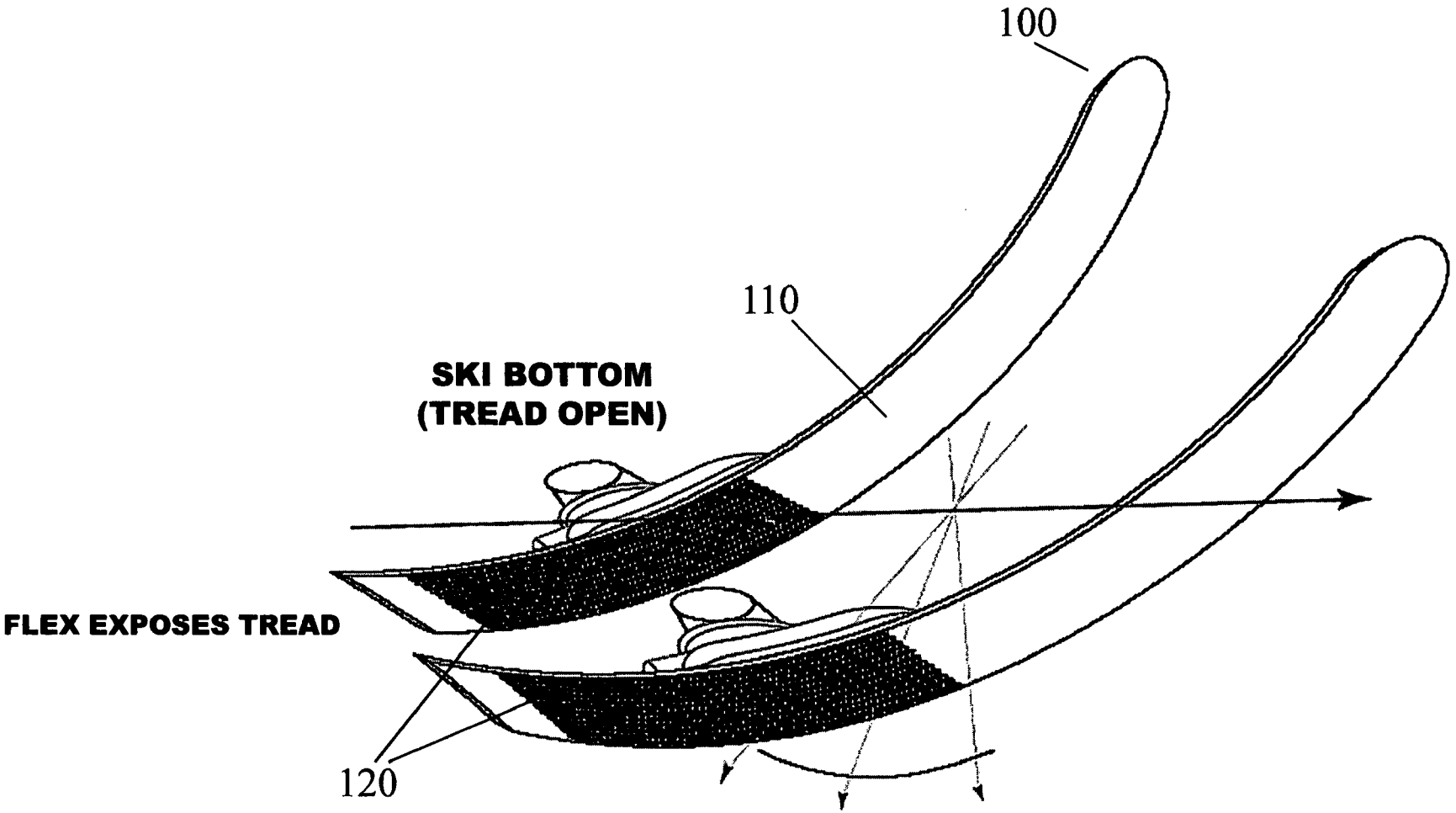
FIG. 2 is a perspective view illustrating a brake integrated into a ski and in the open position when the ski is in a flexed position.
Figure 2A:
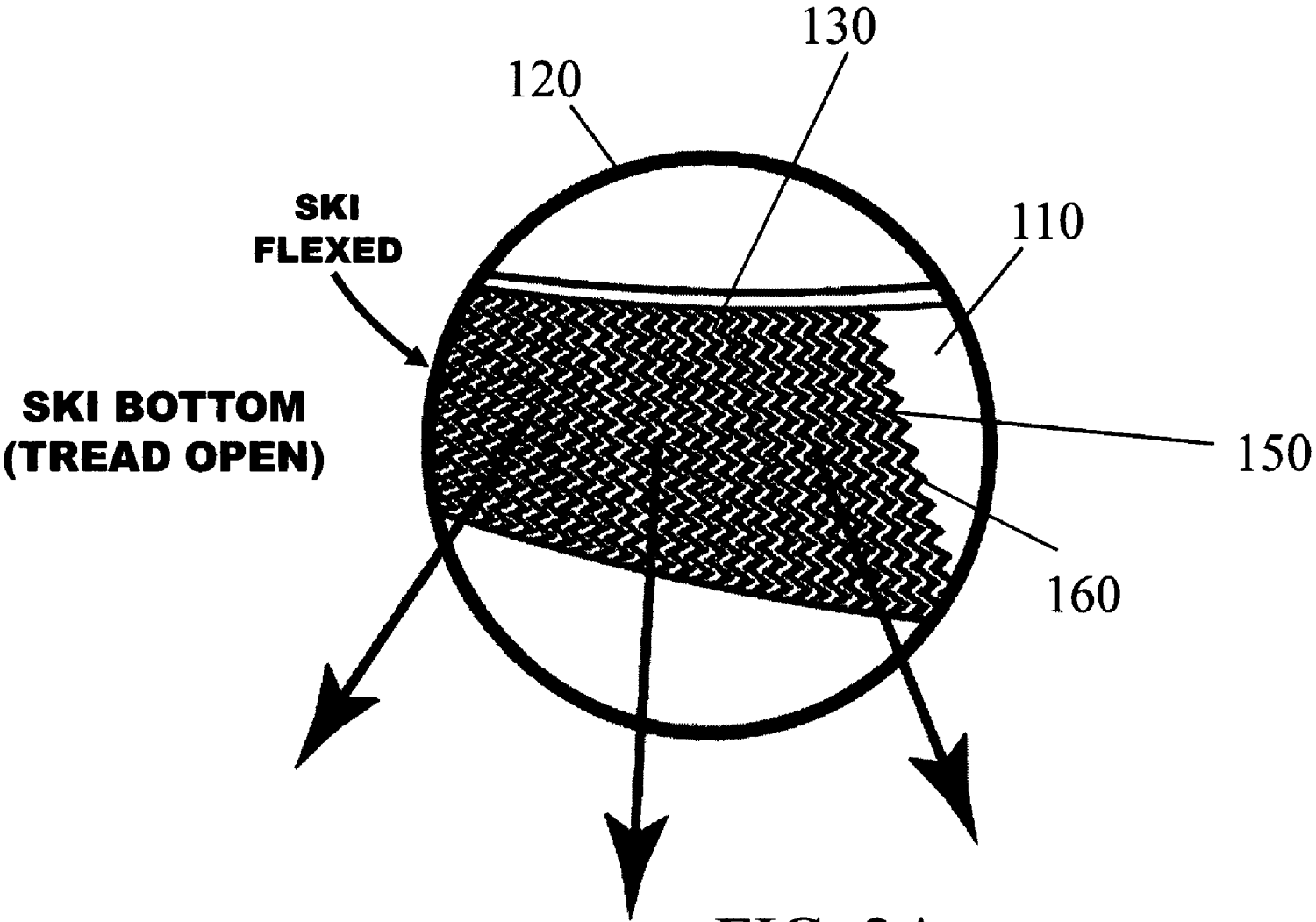
FIG. 2A is a perspective view illustrating a close up of the brake shown in FIG. 2.

FIG. 2 is a perspective view illustrating a brake device 120 that is integrated into a ski bottom 110 while a ski 100 is in a flexed position. As shown in FIG. 2A, when ski bottom 110 is in the flexed position, such as may occur, for example, when a skier falls back on the skis causing the tips of skis to flex in an upward position, a squeegee cut tread 130 is placed in an open position thereby exposing an inner surface 150 to a snow surface. During the open position, the ridges of squeegee cut tread 130 are positioned such that they are not substantially adjacent to one another, but instead a gap is provided between the ridges. The inner surface 150 of squeegee cut tread 130 can comprise an abrasive surface that substantially limits ski bottom 110 from traveling over the snow surface. Thus, while squeegee cut tread 130 is in the open position, the exposed inner surface 150 of squeegee cut tread 130 causes ski bottom 110 to substantially slow or stop relative to a normal operating ski, i.e., when the squeegee cut tread 130 is in the closed position.

Because the inner surface 150 of squeegee cut tread 130 can comprise an abrasive surface and/or expose an increased surface area to a snow surface, ski 100 will slow down or come to a stop as the increased surface area and/or the abrasive inner surface 150 contacts the snow surface. The reduced acceleration of ski 100 causes a reduction in force that is applied to a skier mounted on ski 100. The resultant force is measured in accordance with the following formula: FORCE=MASS×ACCELERATION. As ski 100 reduces acceleration, the force transferred to the skier positioned on ski 100, and particularly the skier's ACL, will be reduced in accordance with the above-stated formula.

When the ski is placed in a non-flexed position, squeegee cut tread 130 is returned to the closed position and inner surface 150 forces out the snow that had accumulated in squeegee cut tread 130. As a result, outer surface 160 is exposed to the snow surface. When squeegee cut tread 130 is returned to its closed position, ski 100 is allowed to travel over the snow surface with substantially similar resistance as to that of a ski during normal operation. The process of flexing and unflexing ski 100 can be repeated during use to the opened and closed position to facilitate slowing of ski 100 and returning to normal operation.

Figure 3:
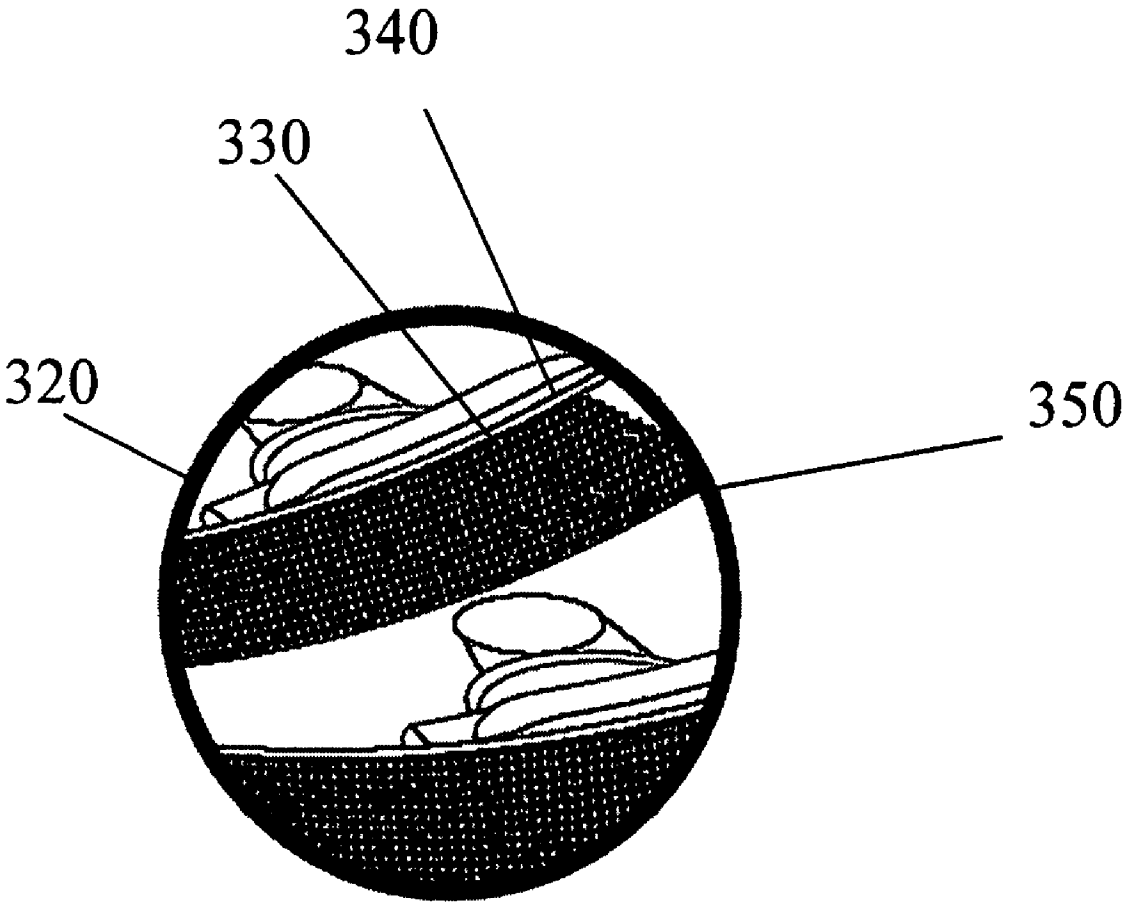
FIG. 3 is a perspective view of a brake that is attached to a ski bottom side according to one embodiment of the present invention.

FIG. 3 is an alternative embodiment of the present invention illustrating a brake 320 that is attached to a ski bottom 110, such that ski brake 320 comprises a first side 330 and a second side 340. The first side further comprises a squeegee cut tread 350 and the second side 340 is attachable to a ski bottom side 110 of ski 100. This embodiment allows the squeegee cut tread 350 to be attached to a ski bottom side 110. The operation of the brake 320 described herein is substantially similar to the operation of brake device 120 that is attached to ski bottom 110 and described above.

Although embodiments of the invention and their advantages are described in detail, a person skilled in the art could make various alterations, additions, and omissions without departing from the spirit and scope of the present invention, as defined by the appended claims.

I claim:

1. A ski brake positioned on a ski, comprising:

a ski brake device intergrated into a bottom side of a ski, comprising a squeegee cut tread with an open position and a closed position;

the squeegee cut tread further comprises an outer surface and an inner surface, wherein the squeegee cut tread exposes the inner surface to a snow surface in the open position when the ski bottom is in a flexed position in order to reduce ski acceleration; and the squeegee cut tread exposes the outer surface to the snow surface in the closed position when the ski bottom is in a non-flexed position during normal operation.

2. The ski brake of claim 1, wherein the inner surface of the squeegee cut tread comprises an abrasive surface.

3. The ski brake of claim 1, wherein the inner surface of the squeegee cut tread comprises an increased surface area as compared to a surface area of the outer surface.

4. The ski brake of claim 1, wherein the outer surface of the squeegee cut tread comprises substantially similar material to the ski bottom side.

5. A ski brake positioned on a ski, comprising:

a ski brake device comprising a first side and a second side wherein the first side is attached to a ski bottom side and the second side comprises a squeegee cut tread with an open position and a closed position;

the squeegee cut tread further comprises an outer surface and an inner surface, wherein the squeegee cut tread exposes the inner surface to a snow surface in the open position when the ski bottom side is in a flexed position in order to reduce ski acceleration; and the squeegee cut tread exposes the outer surface to a snow surface in the closed position when the ski bottom is in a non-flexed position during normal operation.

* * * * *